United States Patent [19]

Perry

[11] 3,949,665

[45] Apr. 13, 1976

[54] BELT AND CARRIER FOR HIGH SPEED PRINTER

[75] Inventor: Richard Anthony Perry, Attleboro, Mass.

[73] Assignee: ODEC Computer Systems, Inc., Warwick, R.I.

[22] Filed: Dec. 4, 1970

[21] Appl. No.: 95,099

[52] U.S. Cl. ..... 101/111; 101/93.14

[51] Int. Cl.[2] ..... B41J 1/20

[58] Field of Search ..... 101/93 C, 111, 93.14

[56] References Cited

UNITED STATES PATENTS

| | | | |
|---|---|---|---|
| 994,971 | 6/1911 | Beck | 101/111 X |
| 1,555,123 | 9/1925 | Kendrick | 101/111 X |
| 3,113,509 | 12/1963 | Simpson | 101/111 |
| 3,142,249 | 7/1964 | Sasaki | 101/111 |
| 3,224,366 | 12/1965 | Cunningham | 101/111 X |
| 3,379,125 | 4/1968 | Antonucci | 101/111 X |
| 3,379,126 | 4/1968 | Staller et al. | 101/111 |
| 3,402,657 | 9/1968 | Potter et al. | 101/93 C |
| 3,435,756 | 4/1969 | Martin | 101/93 C |
| 3,447,455 | 6/1969 | Shneider | 101/93 C |

*Primary Examiner*—Edgar S. Burr
*Assistant Examiner*—Edward M. Coven
*Attorney, Agent, or Firm*—William Frederick Werner

[57] ABSTRACT

A detachable carrier for a high speed chain printer is disclosed. The letter or character carriers which are made of plastic are snapped on the belt and held on the belt without the aid of bolts, clips or other fastening devices. Each carrier is two characters wide.

4 Claims, 8 Drawing Figures

INVENTOR
RICHARD ANTHONY PERRY
BY
William Frederick Werner
ATTORNEY

INVENTOR
RICHARD ANTHONY PERRY
BY
William Frederick Horner
ATTORNEY

BELT AND CARRIER FOR HIGH SPEED PRINTER

BACKGROUND OF THE INVENTION

This invention relates to high speed printers and more specifically to belt or chain printers using a nonmetallic belt and detachable letter or character carriers.

Early high speed printers generally used a rotating drum as the letter or character carrier. In drum printers, the letters or characters are arranged in columns around the drum and the drum rotates in such a manner that the characters travel in a vertical direction with respect to the print line. Any misregistration of characters at the time of print causes a vertical offset of the letter which is very noticeable and offensive to the eye.

In the chain or belt printer, the characters are carried in a horizontal direction and any misregistration is less noticeable and therefore, less offensive. Chain printers at first used metal belts or chains and carriers. These metal belts require lubrication to prevent wear and to operate properly. However, even with extensive lubrication the metal to metal contact causes excessive wear and in addition dust including paper dust interferes with the lubrication. In order to overcome the lubrication problems, nonmetallic belts were developed.

With both the metal and nonmetal belts, several different methods have been devised to attach the letter or character carriers to the belt. All these prior art methods require some securing means for holding the letter or character carriers on the belts. For example, bolts have been used to secure the carrier to the belts as described in U.S. Pat. No. 3,041,964, to Simpson et al. and spring clips have been used to hold a carrier that is clipped over the belt as described in U.S. Pat. No. 3,379,125 to Antonucci. Of course, other methods have also been utilized. In all these methods, some separate securing means are required to hold the carrier on the belt.

This invention provides a plastic carrier that is clipped on the belt and held on the belt without separate fastening or securing means. The carriers are two characters or letters wide and are readily attached to or removed from the belt. No bolts, clips or other securing means are required. The carrier is a single piece carrier made of self-lubricating plastic. The belt used with the carriers is a glass reinforced rubber belt.

SUMMARY OF THE INVENTION

This invention relates to single piece plastic letter or character carriers for high speed chain type printers. The plastic carrier is detachably clipped onto the belt and is secured to the belt without the use of additional fastening means. Each carrier is two letters or characters wide and the carriers are uniformly spaced around the belt.

It is therefore an object of this invention to provide letter or character carriers for chain type printers.

Another object of this invention is to provide plastic letter or character carriers for chain type printers.

Another object of this invention is to provide detachable letter or character carriers for chain type printers.

Another object of this invention is to provide single piece plastic letter or character carrier clips, two characters wide, for chain type printers.

A further object of this invention is to provide letter or character carriers that are detachably secured on the belt of chain type printers without the use of separate fastening means.

A still further object of this invention is to provide a character carrying belt for chain printers which does not require lubrication.

BRIEF DESCRIPTION OF THE DRAWINGS

The above mentioned and other objects of the invention will become readily apparent from the following detailed description of the invention when read in conjunction with the annexed drawings in which.

DESCRIPTION OF THE INVENTION

Figure 1:
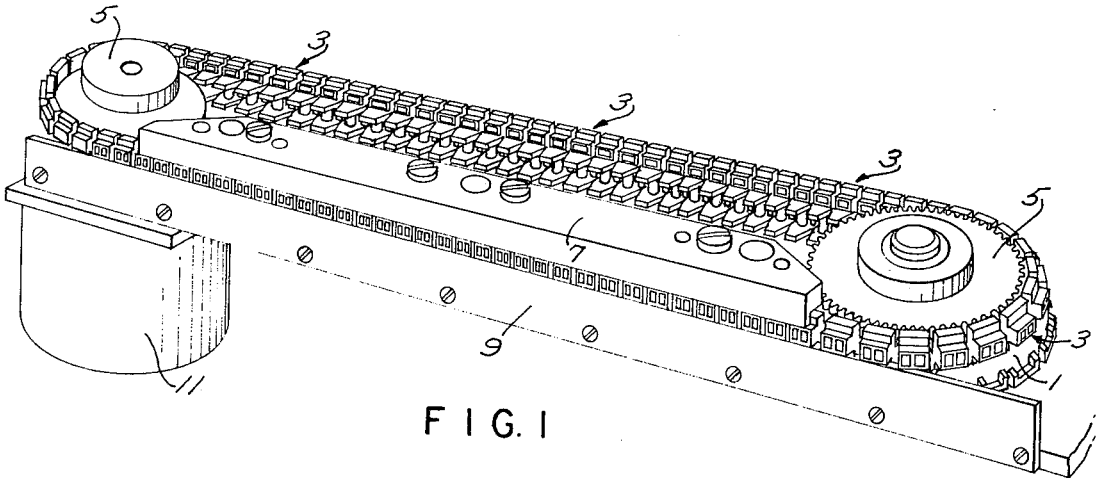
FIG. 1 shows the drive mechanism, guide track and belt of a chain type printer using the carriers of this invention.
Figure 2:
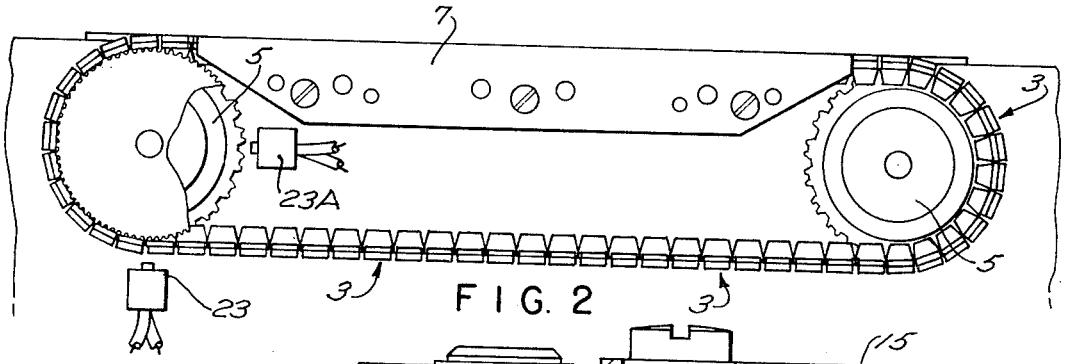
FIG. 2 is a top view of FIG. 1 and in addition shows the sensors used to provide letter or character registration information.

FIG. 1 shows a belt 1 having a plurality of carriers 3 mounted on the belt. The belt 1 is driven by a pair of pulleys 5. A guide bar 15, a front guide 9 and guide plate 7 are utilized to provide belt and carrier guide track. A motor 11 is used to provide driving power to the system. This arrangement of pulleys, guide bar and belt with carriers is of course a conventional arrangement used in chain printers. FIG. 2 is essentially a top view of FIG. 1 and in addition shows a pair of electronic sensors 23 and 23A used to provide letter or character registration information.

Figure 3:
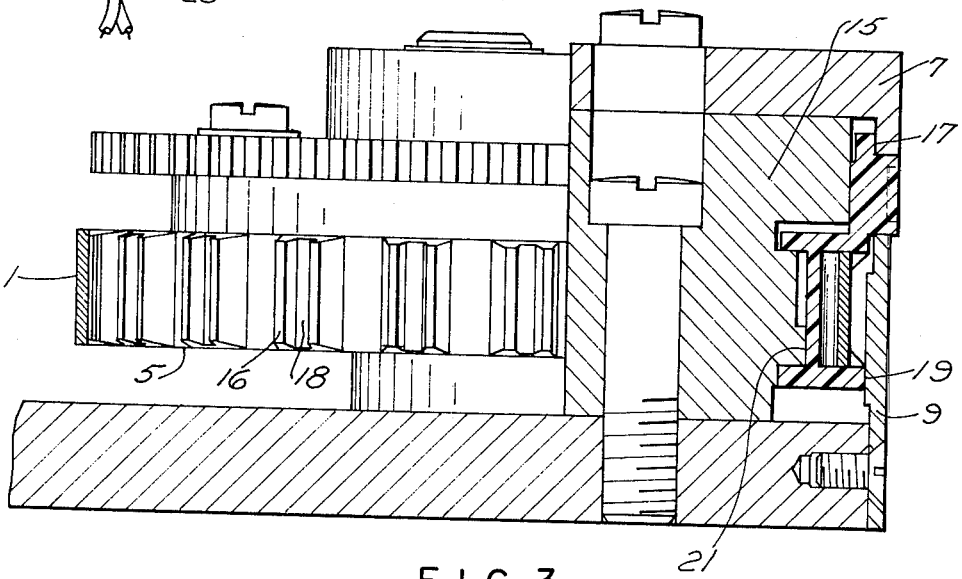
FIG. 3 is a cross-sectional view showing the anvil and guide points in the guide track.

FIG. 3 is a cross-sectional view given to show in detail the anvil 13 and guide surfaces provided by guide bar 15, guide plate 7 and front guide 9. As shown in FIG. 3, a guide track is formed in guide bar 15. The guide bar 15, and guide plate 7 front guide 9 provide three guide surfaces 17, 19, and 21 for the carrier 3. These guide surfaces 17, 19, and 21 insure that the carrier 3 will ride against the anvil 13 and be supported thereby. Anvil 13 provides a fourth guide surface.

Front guide surfaces 17, 19 and rear guide surfaces 13, 21 insure that carrier 3 will maintain proper alignment along the carrier's vertical axis, so that, anvil engaging surface 13A on carrier 3 will be parallel to anvil face 13 at the time the hammer (not shown) strikes a character in indentation 8.

The inside surfaces of platforms 24, 26 prevent the carrier 3 from moving up and down in a vertical plane and therefore the carrier rotates in a horizontal plane.

FIG. 3 clearly shows the relationship of these guide surfaces to belt 1 and a carrier 3, and manifests the benefit of a self lubricating carrier.

Figure 4:
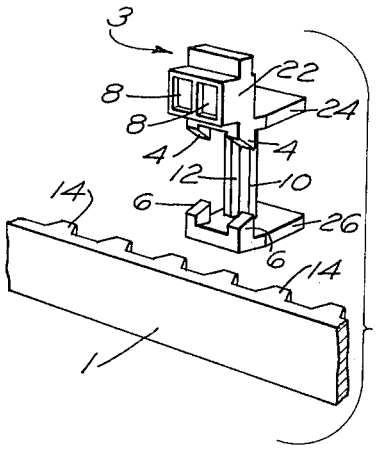
FIG. 4 shows a section of the belt and a carrier constructed in accordance with this invention.

FIG. 4 shows the outside of a section of belt 1 and shows in detail a preferred construction of a carrier 3 constituting the present invention.

Figure 5:
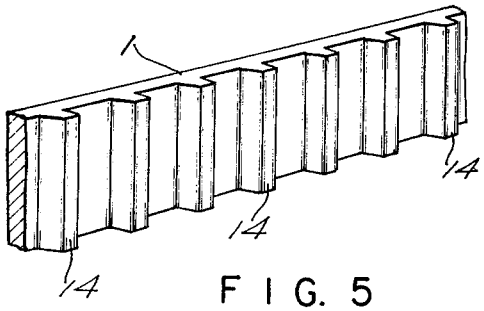
FIG. 5 shows the inside of a section of the belt.

Belt 1 is formed in a closed loop and is preferably made of a glass reinforced synthetic rubber. The inside of belt 1 has a plurality of evenly spaced teeth 14 integrally formed thereon as more clearly shown in FIG. 5.

All of the carriers 3 are identical and are preferably made of a self-lubricating glass reinforced plastic material. The carriers 3 are essentially clips having a letter or character head 22, an upper platform 24 integrally formed with and extending rearwardly from head 22, a lower platform 26 and a vertical post 10 integrally formed with lower platform 26 and upper platform 24 and head 22. Lower platform 26 carries a pair of upwardly extending prongs 6 and head 22 and platform 24 carries a pair of downwardly extending prongs 4. Prongs 4 and 6 are preferably integrally formed as part of the carrier. Post 10 has a groove 12 formed therein along the entire length of the front of the post. A pair of generally rectangular shaped indentations are formed in letter or character head 22. A letter or other character, fabricated preferably from material carrying high magnetic permeability, is fastened in each of the indentations 8; except as will presently appear. Thus, each carrier 3 carries two letters or characters. An anvil engaging surface 13A is located as the rear surface of character head 22 and is located opposite indentations 8.

Figure 6:
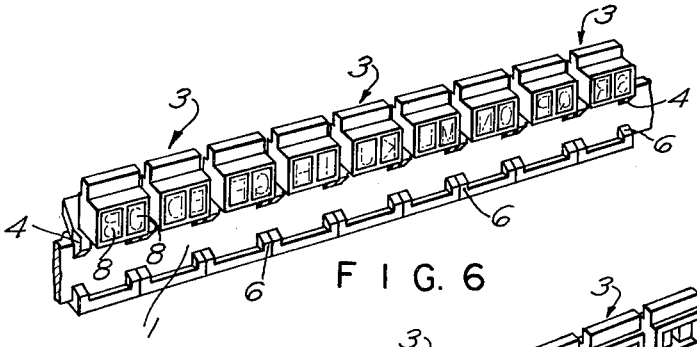
FIG. 6 is an outside view of a section of the belt with the carriers attached to the belt.
Figure 7:
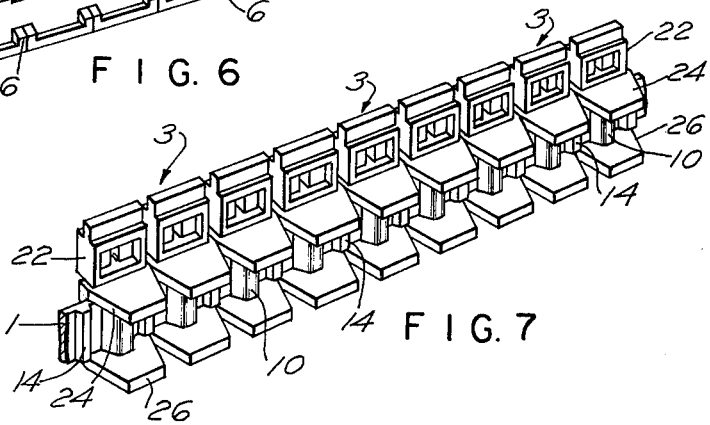
FIG. 7 shows an inside view of a section of the belt with the carriers attached to the belt.

The carriers 3 are slipped over belt 1 and are held on belt 1 by means of upper prongs 4 and lower prongs 6 as clearly shown in FIG. 6. Carriers 3 are held in place along the belt 1 by means of groove 12 in post 10. Each carrier 3 is placed on belt 1 in such a position that its post 10 is centered on a tooth 14 and the tooth therefore slips into the groove 12 thereby preventing movement of the carriers along the belt. Carriers 3 are placed on every other tooth 14 as shown in FIG. 7. Thus, the carriers 3 and therefore the letters or characters are uniformly spaced along belt 1 as shown in FIGS. 6 and 7.

Figure 8:
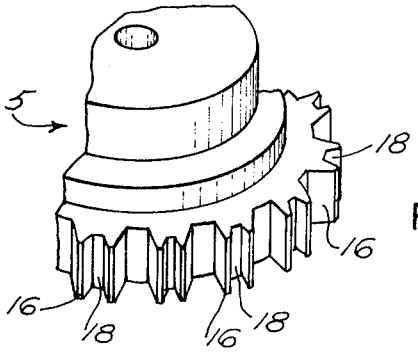
FIG. 8 shows a section of the pulley used to drive the belt.

The teeth 14 not covered by carriers 3 engage the channels or grooves cut in pulley teeth 16. The pulley teeth 16 and grooves or channels 18 are clearly shown in FIG. 8.

Reference is now made to FIG. 2 where a belt timing sensor 23 and a hammer impulse sensor 23A are illustrated.

It has been stated that carriers 3 are spaced uniformly, upon every other tooth along belt 1, the first space on belt 1 being picked at random.

The first carrier 3 placed on belt 1 or any other preselected carrier 3 on belt 1 will be provided with one space 8 void of a magnetic sensitive letter or character. All other indentations 8, except those preselected, will be provided with magnetic sensitive letters and/or characters.

The nature of sensor 23 is such that it will be actuated by the magnetic sensitive characters. As soon as the first blank space 8 is sensed by sensor 23; this information is transferred, as the starting point of belt 1, to the electronic circuiting used with high speed printers. In other words, the blank space or spaces 8 provide position information to indicate the location of a preselected carrier 3 on belt 1.

Motor shaft 11A is provided with a timing gear 5A. Sensor 23A is actuated by metal or magnetic sensitive timing gear 5A which generates timing impulses picked up by sensor 23A, thereby, to time the firing sequence of the hammers (now shown) which strike the characters (not shown) fastened in indentations 8.

The use of electronic sensors as shown in FIG. 2 and the use of guide tracks to provide guidance as shown in FIG. 3 are conventional in the art, but are presented here to show the full function of the carriers 3 deemed new and novel by applicant.

From the foregoing description it is apparent that this invention provides a one piece carrier, two letters and/or characters wide, that can be removably secured to a belt of a high speed chain printer without the need of separate fastening means. Furthermore, the carrier can be quickly and easily mounted on or removed from a belt. The carrier is self-lubricating in its guide tracks.

Having shown and described a preferred embodiment of the present invention by way of example, it should be realized that structural changes could be made and other examples given without departing from either the spirit or scope of this invention.

What I claim is:

1. In a chain type printer, the combination of an endless belt having a plurality of evenly spaced teeth formed along the inner surface and a plurality of one piece print character carriers, each of said carriers comprising a character head for holding at least one print character, an upper platform integrally formed with and extending rearwardly from said head, (an anvil engaging) a face on the rear surface of the character head, a lower platform, a vertical post (having one end integrally formed with said character head and the other end integrally formed with said lower platform), integrally formed with said lower platform and upper platform, a groove in said vertical post to engage one of said plurality of evenly spaced teeth on said inner surface, said endless belt being located between said upper platform and said lower platform, and means for detachably securing said carrier on said belt.

2. The combination as defined in claim 1 wherein said carriers are made of a self-lubricating plastic material.

3. In a chain type printer, the combination of an endless belt having a plurality of evenly spaced teeth formed along the inner surface of said belt and a plurality of one piece print character carriers, each of said carriers comprising a character head having two recesses formed in the front face thereof, each recess providing a print character mounting means, a rear face on the rear surface of said character head, an upper platform integrally formed with and extending rearwardly from said head, a lower platform, a vertical post integrally formed with said lower platform and said upper platform, a groove in said vertical post, said belt being located between said upper platform and said lower platform with said vertical post passing across the inner surface of said belt and with said groove surrounding the exposed surface of one of said teeth, and prong means for detachably securing said carrier on said belt, and guide means for said carriers on the printer comprising a guide bar having an anvil and a plurality of guide surfaces, a guide plate fastened to said guide bar, a front guide, means fastening said front guide to said guide bar, said lower platform having a front guide surface slidably engageable with said front guide, and a rear guide surface slidably engageable with one of said plurality of guide surfaces, said upper platform slidably engageable with another of said plurality of guide surfaces, to guide said carriers in a horizontal plane, said vertical post provided with a rear guide surface slidably engageable with another of said plurality of guide surfaces, said rear face on the rear surface of the character head slidably engageable with said anvil, said character head having a second front guide surface slidably engageable with said guide plate, thereby, providing means for said carrier to move through a guided path.

4. In a chain type printer, the combination of an endless belt having a plurality of evenly spaced teeth formed along the inner surface of said belt and a plurality of one piece print character carriers on the inner surface of said belt, each of said carriers having a character head with a front surface and a rear surface, a plurality of character faces located on said front surface of said carrier head in horizontal alignment, a rear face on the rear surface of said character head, an upper platform, said character head projecting upwardly from said upper platform, said upper platform extending rearwardly from said character head to provide a first horizontal guide surface, a lower platform, a vertical post having one end integrally formed with said upper platform and the other end integrally formed with said lower platform, said lower platform extending rearwardly from said vertical post to provide a second horizontal guide surface parallel to said first horizontal guide surface, a vertical groove in said vertical post with said groove surrounding the exposed surface of one of said plurality of evenly spaced teeth on said inner surface, said belt being located between said upper platform and said lower platform, and guide means for said carriers on the printer comprising a guide bar having an anvil and a plurality of guide surfaces adapted to provide a horizontal guide track for said first horizontal guide surface and for said second horizontal guide surface with said rear face slidably engaging said anvil.

* * * * *